US006517310B2

(12) United States Patent
Marx et al.

(10) Patent No.: US 6,517,310 B2
(45) Date of Patent: Feb. 11, 2003

(54) FEED PUMP

(75) Inventors: Peter Marx, Wasbüttel (DE); Peter Schuchardt, Rotenburg (DE); Hans-Peter Osburg, Alheim (DE)

(73) Assignee: Mannesmann VDO AG, Frankfurt am Main (DE)

( * ) Notice: Subject to any disclaimer, the term of this patent is extended or adjusted under 35 U.S.C. 154(b) by 0 days.

(21) Appl. No.: 09/811,853

(22) Filed: Mar. 19, 2001

(65) Prior Publication Data

US 2001/0026757 A1 Oct. 4, 2001

(30) Foreign Application Priority Data

Mar. 21, 2000 (DE) ..... 100 13 908

(51) Int. Cl.[7] ..... F04D 5/00
(52) U.S. Cl. ..... 415/55.7; 415/915
(58) Field of Search ..... 415/55.1, 55.5, 415/55.7, 915; 416/234

(56) References Cited

U.S. PATENT DOCUMENTS 3,782,851 A * 1/1974 Hackbarth et al. ..... 415/143
3,951,567 A * 4/1976 Rohs ..... 415/119
5,702,229 A * 12/1997 Moss et al. ..... 415/55.1
5,762,469 A * 6/1998 Yu ..... 415/55.1
5,807,068 A * 9/1998 Dobler et al. ..... 415/55.1
6,132,185 A * 10/2000 Wilhelm ..... 415/55.1
6,152,687 A * 11/2000 Wilhelm et al. ..... 415/55.1
6,152,688 A * 11/2000 Staab et al. ..... 415/169.1
6,302,639 B1 * 10/2001 Endler et al. ..... 415/55.1

FOREIGN PATENT DOCUMENTS

DE 195 04 079 8/1996 ..... F04D/5/00
DE 196 15 322 10/1997 ..... F04D/5/00
EP 0 884 479 3/1988 ..... F04D/5/00

* cited by examiner

*Primary Examiner*—Edward K. Look
*Assistant Examiner*—Richard A. Edgar
(74) *Attorney, Agent, or Firm*—Cohen, Pontani, Lieberman & Pavane

(57) ABSTRACT

A feed pump designed as a side-channel or peripheral pump has two rings of guide vanes arranged in an impeller and concentrically enclosing one another. The sides of the guide vanes facing the intended direction of rotation of the impeller are inclined at an angle relative to the axis of rotation of the impeller. The angles of the guide vanes in a radially outer ring of guide vanes are larger than the angles of guide vanes in a radially inner ring of guide vanes. This arrangement allows the impeller to be produced in an injection mold in an especially cost-effective manner.

6 Claims, 2 Drawing Sheets

FEED PUMP

BACKGROUND OF THE INVENTION

1. Field of the Invention

The invention relates to a feed pump having a driven impeller which rotates in a pump housing and has a plurality of rings of vane chambers which are arranged at an end face of the impeller and concentrically enclose one another, feed channels arranged opposite the rings of the vane chambers in a wall of the pump housing, and guide vanes which define the vane chambers relative to the impeller and which are arranged so as to be inclined by an angle with respect to the axis of rotation of the impeller.

2. Description of the Related Art

Feed pumps having impellers with plural rings of vane chambers are often used for feeding fuel or washing liquid in modern motor vehicles and are known from practice as peripheral- or side-channel pumps. The impeller is typically fastened in a rotationally fixed manner to a shaft driven by an electric motor. During rotation of the impeller, circulation flows are produced in the vane chambers and a feed channel defined in the pump housing. The circulation flows deliver the fuel or the washing liquid from an inlet channel to an outlet channel. When the plural rings of vane chambers concentrically enclose one another, the feed pump may have several pressure stages or may supply various loads independently of one another. The impeller is usually produced by the injection molding or injection-compression molding process with tool molds corresponding to the impeller. The inclination of the guide vanes relative to the axis of rotation allows the feed pump to have a very high efficiency.

However, a problem with the known feed pump is that it is very costly to produce. For example, the rings of the vane chambers in each case require a complicated mold. During the demolding of the impeller from the mold, i.e., removal of the impeller from the mold, the impeller and the mold must be moved relative to one another in a specific manner. In addition, these relative movements must be followed precisely to avoid damage to the guide vanes.

SUMMARY OF THE INVENTION

The object of the present invention is to provide a feed pump having an impeller with guide vanes that are inclined by an angle with respect to the axis of rotation of the impeller such that the impeller may be manufactured with a high efficiency in a cost-effective manner.

The object is met according to an embodiment of the present invention by an impeller having rings of vane chambers delimited by guide vanes in which the guide vanes are inclined by an angle with respect to an axis of rotation of the impeller and the angle of the guide vanes is arranged to that it increases proportionally with increasing distance from the center of the impeller in the radial extent of the guide vanes. Furthermore, the angles of each of the guide vanes in a plurality of rings of the guide vanes arranged at one of the end faces has the same proportional relationship.

A suitable selection of the proportionality of the variation in the angle with respect to the distance of the guide vanes from the center of the impeller allows a common mold part to be used for producing a plurality of rings of the vane chambers. The use of a single mold part allows the impeller to be demolded without regard to relative movements. As a result, the feed pump according to the invention may be produced with a high efficiency and in a cost-effective manner. In addition, damage to the guide vanes caused by an incorrectly executed relative movement of the mold and the impeller during demolding is avoided. Furthermore, this design of the impeller allows a small number of mold parts to be used for production. The impeller may be produced with a total of two mold parts opposite one another. This produces an especially cost-effective tool use during the production of the impeller.

An especially high efficiency of the feed pump according to the invention, with ease of demolding of the impeller, may be produced in a simple manner if the angle of the guide vanes runs according to the formula $$\alpha(r) = \arctan\left[\frac{r * \tan(\alpha[r_a])}{r_a}\right],$$

where r is any desired distance of an intended point of the guide vanes from the center of the impeller and $\alpha(r_a)$ is a desired angle at radius $r_a$. The proportionality of the angular variation with increasing distance from the center of the impeller can be established in a simple manner by this design. Since the relative proportions given in the formula have a decisive effect on the forming circulation flow, flow losses are kept especially low. The flows in the feed channel are adapted to those in the vane chambers.

According to another advantageous development of the invention, the demolding of the impeller is further simplified if the angle β of the side of the guide vanes facing away from the intended direction of rotation at the distance r is slightly larger than the angle α(r). This embodiment produces guide vanes that are thickened slightly with increasing distance from their nearest end face of the impeller. The mold part provided for the production of the vane chambers may therefore have tapering projections for the production of the vane chambers, so that the impeller can be removed in a simple manner after release from the mold part.

According to an embodiment of the invention, flow losses inside the feed channels or the vane chambers are kept especially low if the guide vanes have an angle α(r) within the range including 10° to 50°. The range of the angle α(r), at an intended distance of the corresponding rings of the guide vanes from the center of the impeller may be established in a simple manner by selection of the angle $\alpha(r_a)$.

According to another advantageous development of the invention, the flow losses in the feed channel or the vane chambers are further reduced if the angle a(r) is within the range including 15° and 38°.

The efficiency of the feed pump according to the invention is further increased if the vane chambers pass through the impeller and in each case have a guide vane at the end faces of the impeller, and if the guide vanes are oriented relative to the end faces so as to point in the intended direction of rotation of the impeller. This configuration allows axial flow through the feed pump and the impeller may therefore be of very compact construction in the radial direction.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
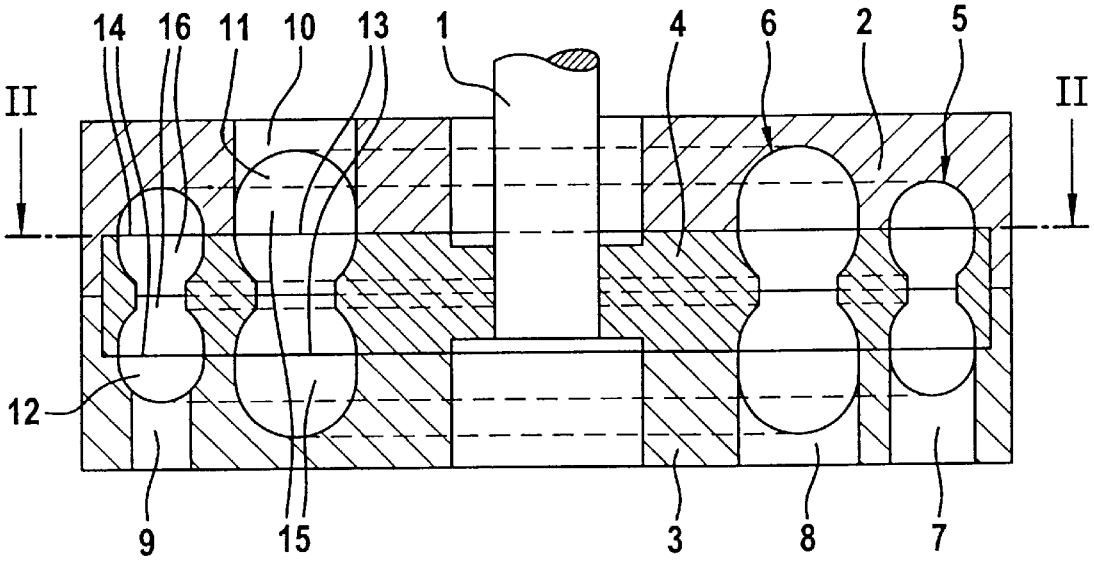
FIG. 1 is an axial sectional view of a feed pump according to an embodiment of the present invention.

FIG. 1 is an axial sectional view of a feed pump designed as a side-channel pump according to an embodiment of the present invention. The feed pump has an impeller 4 fastened to a shaft 1 and rotatable between two fixed housing parts 2, 3. The feed pump has two feed chambers 5, 6 concentrically enclosing one another. The feed chambers 5, 6 respectively extend from inlet channels 7, 8 to outlet channels 9, 10. The feed chambers 5, 6 respectively include feed channels 11, 12 arranged in the housing parts 2, 3 and of vane chambers 15, 16 arranged in the impeller 4. The vane chambers 15, 16 are respectively defined by guide vanes 13, 14. Each of the vane chambers 15, 16 is arranged as a recess in one of the end faces of the impeller 4. Vane chambers 15 arranged opposite one another on the impeller 4 are connected to one another. Likewise, vane chambers 16 arranged opposite one another on the impeller 4 are connected to one another. Rotation of the impeller 4 produces circulation flows leading from the inlet channels 7, 8 to the outlet channels 9, 10 in the feed chambers 5, 6.

Figure 2:
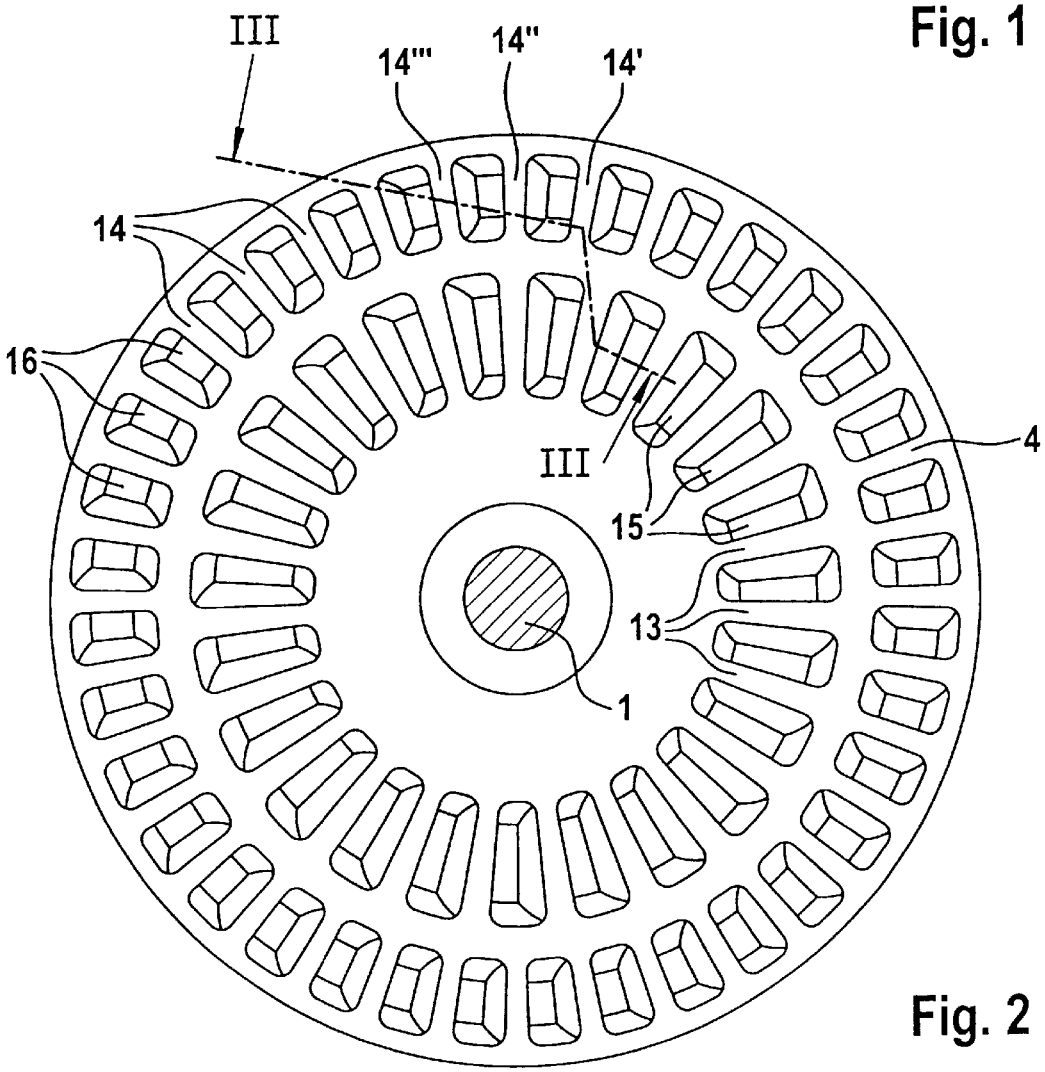
FIG. 2 is a sectional view of the feed pump of FIG. 1 along line II—II showing an end face of an impeller of the feed pump.

FIG. 2 is a sectional view of the feed pump from FIG. 1 along line II—II showing a plan view of one of the end faces of the impeller 4. In this embodiment, two rings of vane chambers 15, 16 are arranged in the impeller 4. The rings of vane chambers 15, 16 enclose one another concentrically. Furthermore, the guide vanes 13 defining the vane chambers 15 and guide vanes 14, 14', 14", 14'" defining the vane chambers 16 are shown in FIG. 3.

Figure 3:
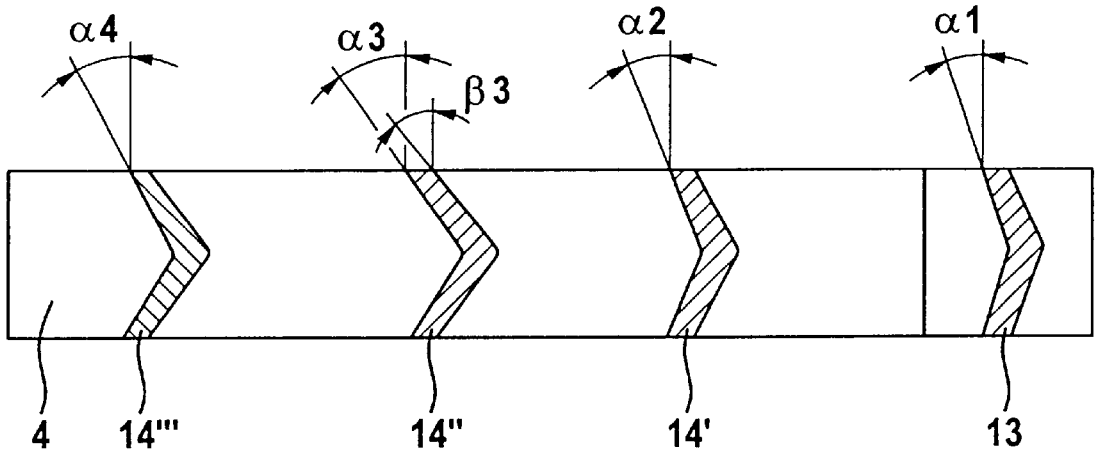
FIG. 3 is an enlarged sectional view through the impeller of FIG. 2 along line III—III.

FIG. 3 is a sectional view of the impeller 4 from FIG. 2 which shows a plurality of guide vanes 13, 14', 14", 14'". The sides of these guide vanes 13, 14', 14", 14'" which face the intended direction of rotation of the impeller 4 respectively have angles $\alpha 1$–$\alpha 4$ at which these sides are inclined relative to the perpendicular and thus to the axis of rotation of the impeller 4. As is apparent from FIG. 3, the angle $\alpha 1$ of the guide vane 13 of the inner ring of the vane chambers 15 shown in FIG. 2 is smaller than the angles $\alpha 2$–$\alpha 4$ of the guide vanes 14', 14", 14'" of the outer ring of the vane chambers 16. Furthermore, the sizes of the angles $\alpha 2$–$\alpha 4$ changes in dependence on the distance of the intersection of the guide vane 14', 14", 14'" from the axis of rotation of the impeller 4. The inclination of the guide vane 14', 14", 14'" relative to the axis of rotation of the impeller 4 increases with increasing distance from the axis of rotation of the impeller 4. The angle $\alpha 4$ is thus larger than the angle $\alpha 2$. The side of the guide vanes 14', 14", 14'", 13 facing away from the intended direction of rotation of the impeller 4 has an angle $\beta$. The guide vanes 14, 14', 14", 14'", 13 are arranged so that the angle $\beta$ is slightly larger than the angle $\alpha$ of the side facing in the direction of rotation of the impeller 4. For example, FIG. 3 shows that the angle $\beta 3$ is slightly larger than the angle $\alpha 3$. This configuration facilitates demolding of the impeller 4 which is produced by the injection molding process from the mold (not shown) in a simple manner.

Figure 4:
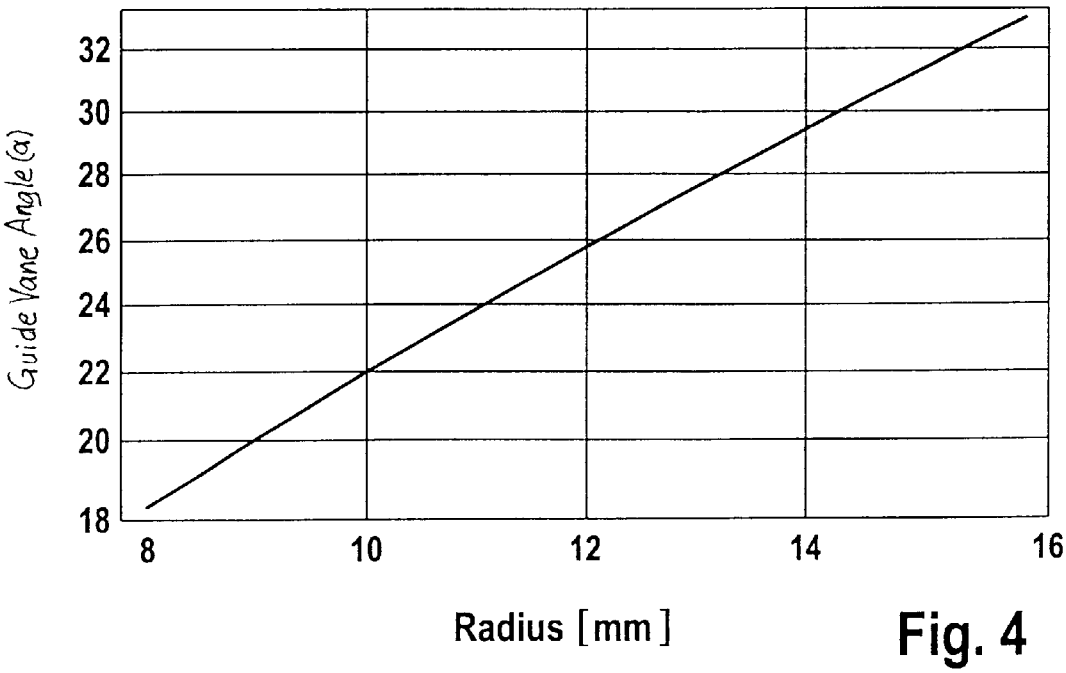
FIG. 4 is a diagram plotting a guide-vane angle against the distance from the center of the impeller of the feed pump from FIG. 1.

FIG. 4 shows a diagram of the vane angle $\alpha(r)$, with r=1, 2, 3 . . . , plotted against the distance of the intersection of the guide vanes 13, 14 from the axis of rotation of the impeller 4. The angle $\alpha(r)$ of the guide vanes relative to the axis of rotation of the impeller behaves according to the relationship $$\alpha(r) = \arctan\left[\frac{r * \tan(\alpha[r_a])}{r_a}\right].$$

At an angle $\alpha(ra)=22°$ preset at the location ra=10 mm, a curve is obtained for the angular variation of the guide vanes 13, 14 shown in FIGS. 1–3. The angle $\alpha(r)$ increases with increasing distance r from the axis of rotation. However, the rate of increase in the angle $\alpha(r)$ decreases with increasing distance r from the axis of rotation of the impeller 4. Of course, the angle $\alpha(ra)$ may be preset to other values as required by the particular requirements of the application in which the impeller 4 is installed.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A feed pump, comprising:

a pump housing having at least one wall;

a driven impeller having at least one end face and rotatably arranged in said pump housing for rotation about an axis of rotation, said driven impeller having a plurality of rings of vane chambers concentrically arranged at said at least one end face of said impeller, said at least one wall of said pump housing having feed channels arranged opposite said plural rings of the vane chambers on said at least one end face of said impeller; and guide vanes arranged on said driven impeller defining circumferential ends of said vane chambers, a first side of each of said guide vanes facing an intended direction of rotation being inclined by an angle relative to said axis of rotation of said impeller, wherein said angle of said first side of said guide vanes is in a proportional relationship with a distance from said axis of rotation such that said angle increases in proportion with an increasing distance from said axis of rotation, and wherein each of said guide vanes of said plurality of ring of vane chambers arranged on one end face of said at least one end face has the same proportional relationship.

2. The feed pump of claim 1, wherein said angle of said first side of said guide vanes runs according to the formula $$\alpha(r) = \arctan\left[\frac{r * \tan(\alpha[r_a])}{r_a}\right],$$

where r is a distance of a point of the guide vanes from said axis of rotation of said impeller and $\alpha(r_a)$ is a desired angle at distance $r_a$.

3. The feed pump of claim 1, wherein said angle of said first side of said guide vanes is within a range including 10° to 50°.

4. The feed pump of claim 1, wherein a second side of said guide vanes facing away from the intended direction of rotation is inclined at an angle relative to said axis of rotation, wherein said angle of said second side of said guide vanes is larger than said angle of said first side of said guide vanes.

5. The feed pump of claim 1, wherein said angle of said first side of said guide vanes is within a range including 15° to 38°.

6. The feed pump of claim 1, wherein said impeller comprises two end faces and said vane chambers pass through said impeller such that a first set of said guide vanes are arranged at one of said two end faces and a second set of guide vanes are arranged at the other of said two end faces, and wherein each of said guide vanes in said first and second sets of said guide vanes is oriented relative to a corresponding one of said two end faces such that said each of said guide vanes points in the intended direction of rotation of said impeller at said corresponding one of said two end faces.

* * * * *